United States Patent [19]

Yano et al.

[11] 4,408,530

[45] Oct. 11, 1983

[54] AUTOMATIC PRINTING PLATE EXCHANGE SYSTEM

[75] Inventors: Tadashi Yano; Noriyuki Hoshino, both of Mihara, Japan

[73] Assignee: Mitsubishi Jukogyo Kabushiki Kaisha, Tokyo, Japan

[21] Appl. No.: 407,783

[22] Filed: Aug. 13, 1982

[51] Int. Cl.[3] ..... B41F 27/12; B41F 1/28

[52] U.S. Cl. ..... 101/415.1; 101/DIG. 12

[58] Field of Search ..... 101/382 R, 415.1, 395, 101/DIG. 12, 132, 216–217

[56] References Cited

U.S. PATENT DOCUMENTS

| | | | |
|---|---|---|---|
| 3,010,394 | 11/1961 | Borchers et al. | 101/415.1 X |
| 3,719,142 | 3/1973 | Abe | 101/415.1 |
| 3,750,573 | 8/1973 | Haeusler | 101/415.1 |

FOREIGN PATENT DOCUMENTS

| | | | |
|---|---|---|---|
| 1174330 | 7/1964 | Fed. Rep. of Germany | 101/415.1 |
| 2031711 | 1/1971 | Fed. Rep. of Germany | 101/415.1 |
| 2804970 | 8/1978 | Fed. Rep. of Germany | 101/415.1 |
| 358101 | 11/1961 | Switzerland | 101/415.1 |

*Primary Examiner*—E. H. Eickholt

*Attorney, Agent, or Firm*—Wenderoth, Lind & Ponack

[57] ABSTRACT

An improved automatic printing plate exchange system is described herein, which comprises plate holding means adapted to be mounted to a printing plate while presenting a resilient effect as a whole and having anchor-shaped engaging sections along its front and rear edges, send-out means for sequentially sending out plates, which have been preliminarily arrayed in a predetermined order, up to a predetermined position, conveyor means for receiving the plate sent out from said send-out means by engaging with the anchor-shaped engaging section of said plate holding means and conveying the plate up to a predetermined position above a printing section, a printing cylinder on which said plate can be mounted, and delivery means for receiving the plate from the conveyor means by engaging with the anchor-shaped engaging section and delivering the plate to said printing cylinder.

1 Claim, 23 Drawing Figures

AUTOMATIC PRINTING PLATE EXCHANGE SYSTEM

The present invention relates to an automatic exchange system for a plate in a printing machine.

Figure 1:
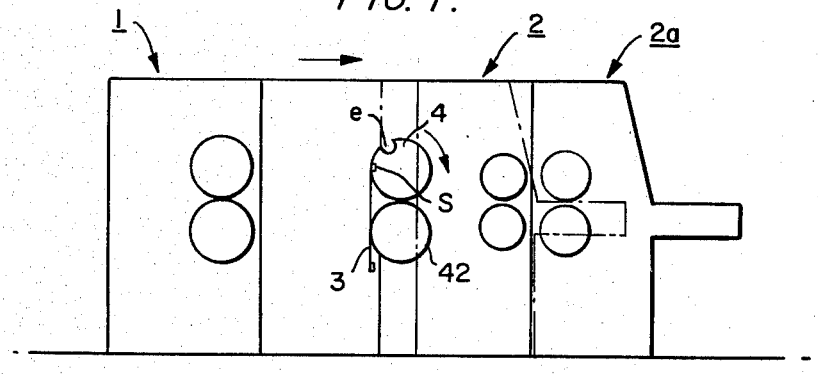

In general, printing sections in paper working machines are classified into two types of an upper printing type and a lower printing type, and in either type, mounting and dismounting of a plate sheet onto and from a printing cylinder have been carried out entirely through a manual operation, after a space for mounting a plate sheet (3) onto a printing cylinder (4) has been established by separating a printing section (2) and a paper feed section (2*a*) from a paper eject section (1) as shown in FIG. 1 which illustrates one example of the upper printing system in the prior art. The outline of this working procedure will be explained in the following.

Figure 2:
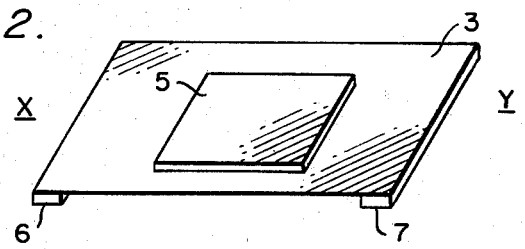

At first, explaining the mounting operation of the plate sheet (3), it consists of the following steps:

(a) A front fixture strip (6) of a plate sheet (3) as shown in FIG. 2 (X in FIG. 2 indicates a front side, while Y indicates a rear side) is inserted into a mounting slot (S) of a printing cylinder (4) shown in FIG. 1 to mount the front edge of the plate sheet (3) onto the printing cylinder (4).

(b) Then, the printing cylinder (4) is made to rotate in the direction of an arrow by actuating a push-button switch (not shown).

(c) Subsequently, the plate sheet (3) is wrapped around the printing cylinder (4) by one hand.

Figure 3A:
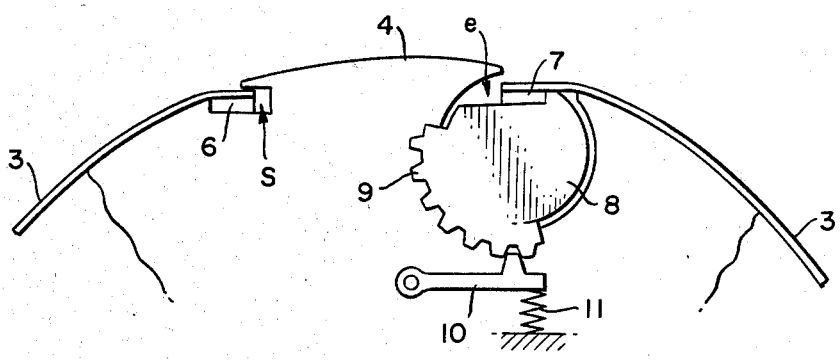
Figure 3B:
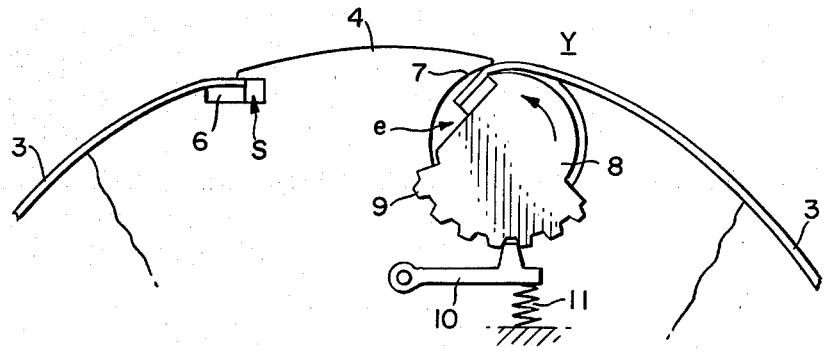

(d) Next, a rear fixture strip (7) is fitted into a slot (e) on the printing cylinder (4) (FIG. 3(*a*)).

(e) Further, a fastening shaft (8) is rotated in the direction of an arrow as shown in FIG. 3(*b*) to attract the plate sheet (3) from its rear end portion, and finally the plate sheet (3) is fixed in a stretched state by means of a ratchet wheel (9) provided on an end surface of the fastening shaft (8) and a claw (10). It is to be noted that reference numeral (5) in FIG. 2 denotes a plate for printing.

Next, explaining the dismounting operation of the plate sheet (3), it consists of the following steps:

(a) At first, the claw (10) is disengaged from the ratchet wheel (9) which has been engaged with the former.

(b) Then the plate sheet (3) is relaxed by rotating the fastening shaft (8) in the direction opposite to the arrow (the state shown in FIG. 3(*a*)), and thereby the rear fixture strip (7) is disengaged from the slot (e).

(c) Subsequently, while the printing cylinder is rotated in the direction opposite to the arrow shown in FIG. 1, the plate sheet (3) is unwrapped from its rear end portion.

(d) Further, the front fixture strip (6) is disengaged from the slot (S) on the printing cylinder (4) and then the plate sheet (3) is removed.

However, the above-mentioned process in the prior art had the following shortcomings. That is, as a preparatory step for exchanging the plate sheet (3) it was necessary to move the printing section (2) and the paper feed section (2*a*) from the position contiguous to the paper eject section (1) indicated by dash-dot lines to the position indicated by solid lines as shown in FIG. 1. Also, exchange of the plate sheet (3) had to entirely rely upon manual operations, and further, after the exchange was finished it was also necessary to restore the printing section (2) and the paper feed section (2*a*) which had been separated from the paper eject section (1) in the above-described manner to the position indicated by dash-dot lines in FIG. 1. Therefore, the process in the prior art had a disadvantage that a lot of labor and time were necessitated before operation is restarted.

It is a principal object of the present invention to provide an automatic printing plate exchange system which is free from the above-mentioned shortcomings in the prior art.

A more specific object of the present invention is to provide an automatic printing plate exchange system in which a time required for set up can be greatly shortened, hence a productivity is enhanced by the corresponding amount, and thereby labor saving and safety can be improved.

According to one feature of the present invention, there is provided an automatic printing plate exchange system comprising plate holding means adapted to be mounted to a printing plate while presenting a resilient effect as a whole and having anchor-shaped engaging sections along its front and rear edges, send-out means for sequentially sending out plates, which have been preliminarily arrayed in a predetermined order, up to a predetermined position, conveyor means for receiving the plate sent out from said send-out means by engaging with the anchor-shaped engaging section of said plate holding means and conveying the plate up to a predetermined position above a printing section, a printing cylinder on which said plate can be mounted, and delivery means for receiving the plate from the conveying means by engaging with the anchor-shaped engaging section and delivering the plate to said printing cylinder.

According to the present invention, since the automatic printing plate exchange system is constructed in the above-featured manner, plate sheets to be exchanged sequentially can be preset preliminarily at any desired place outside of the printing machine in a cartridge-like fashion, and the preset plate sheet can be automatically mounted and dismounted in a predetermined sequence onto and from the printing cylinder with the aid of hydraulic cylinders by merely operating push-buttons.

Figure 4:
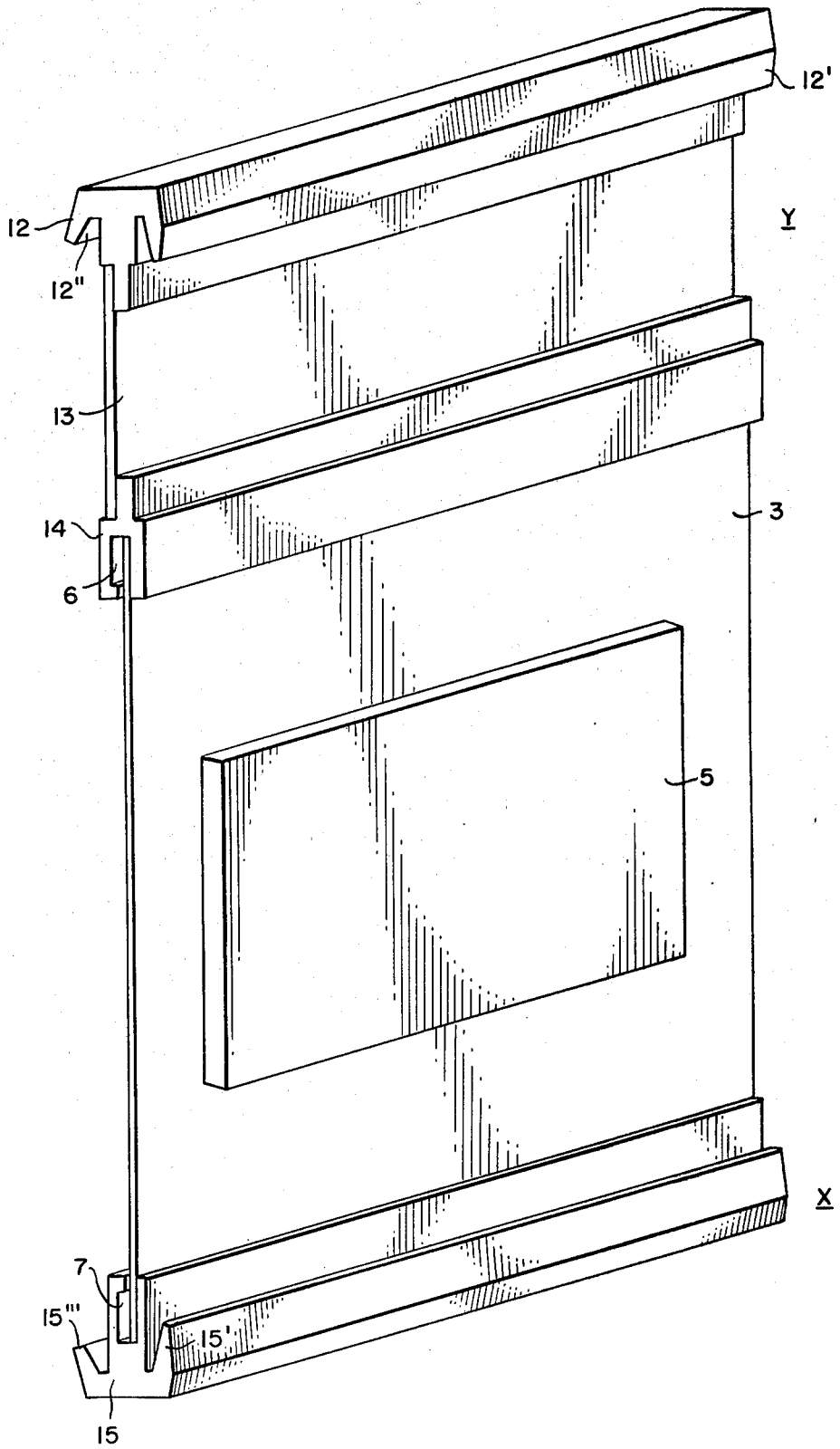
Figure 5A:
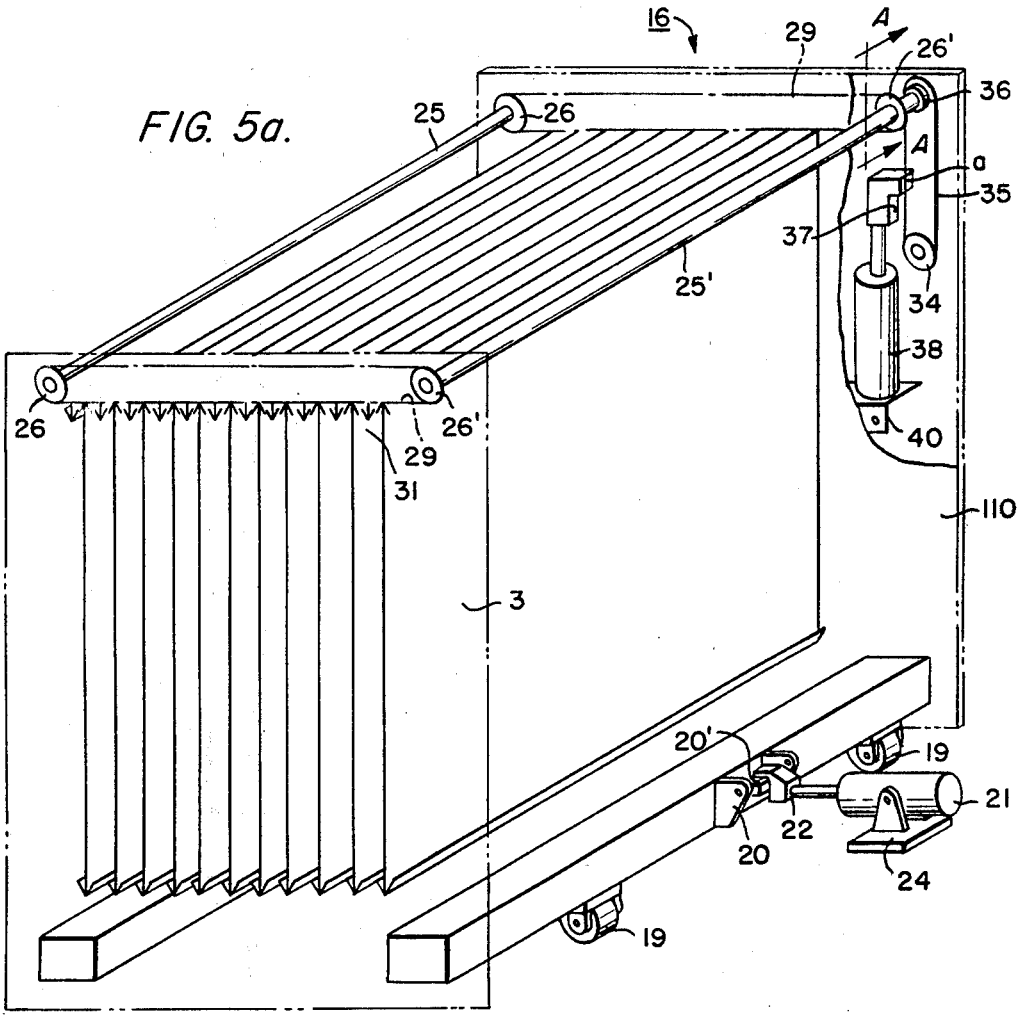
Figure 5B:
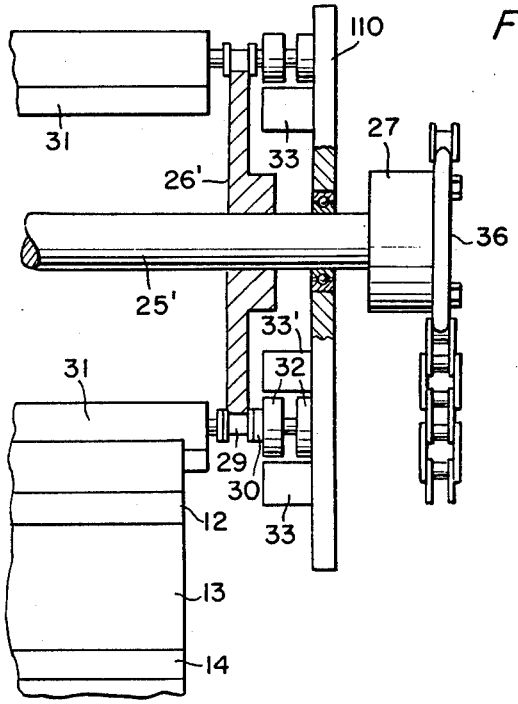
Figure 6:
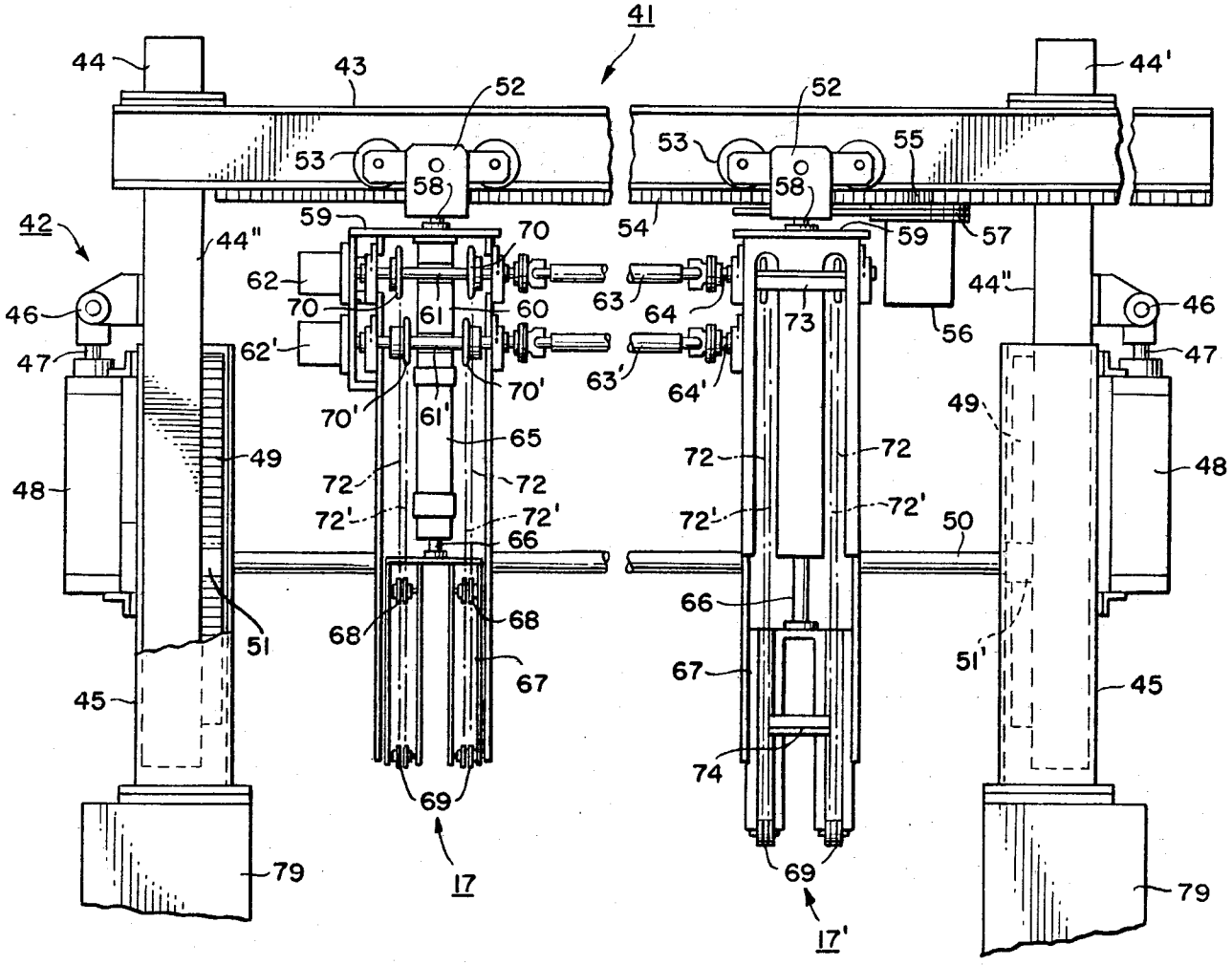
Figure 7:
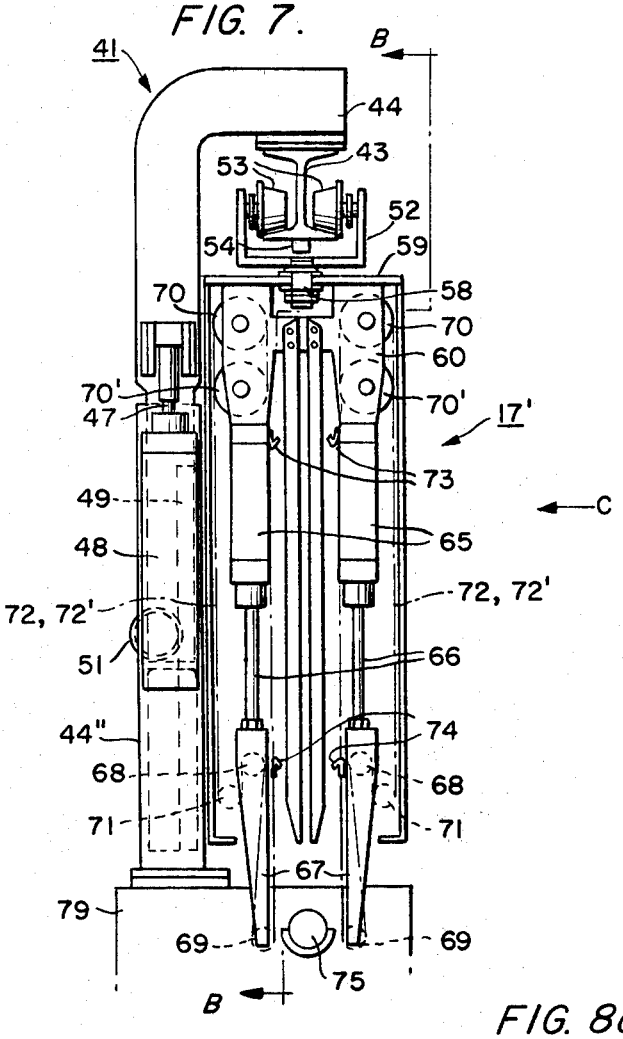
Figure 8B:
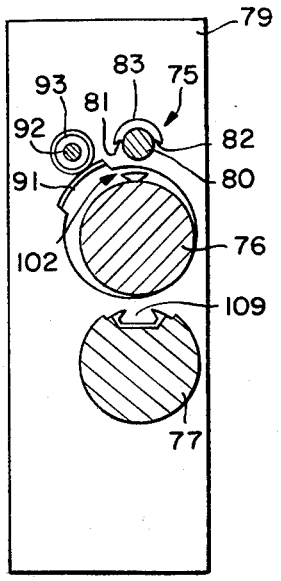
Figure 8A:
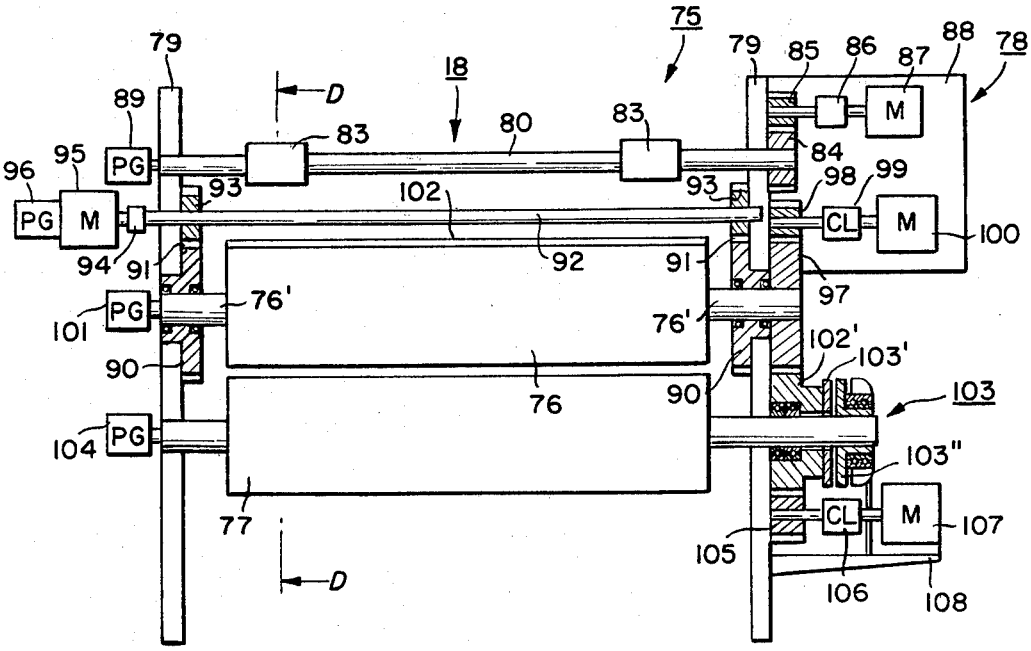
Figure 9:
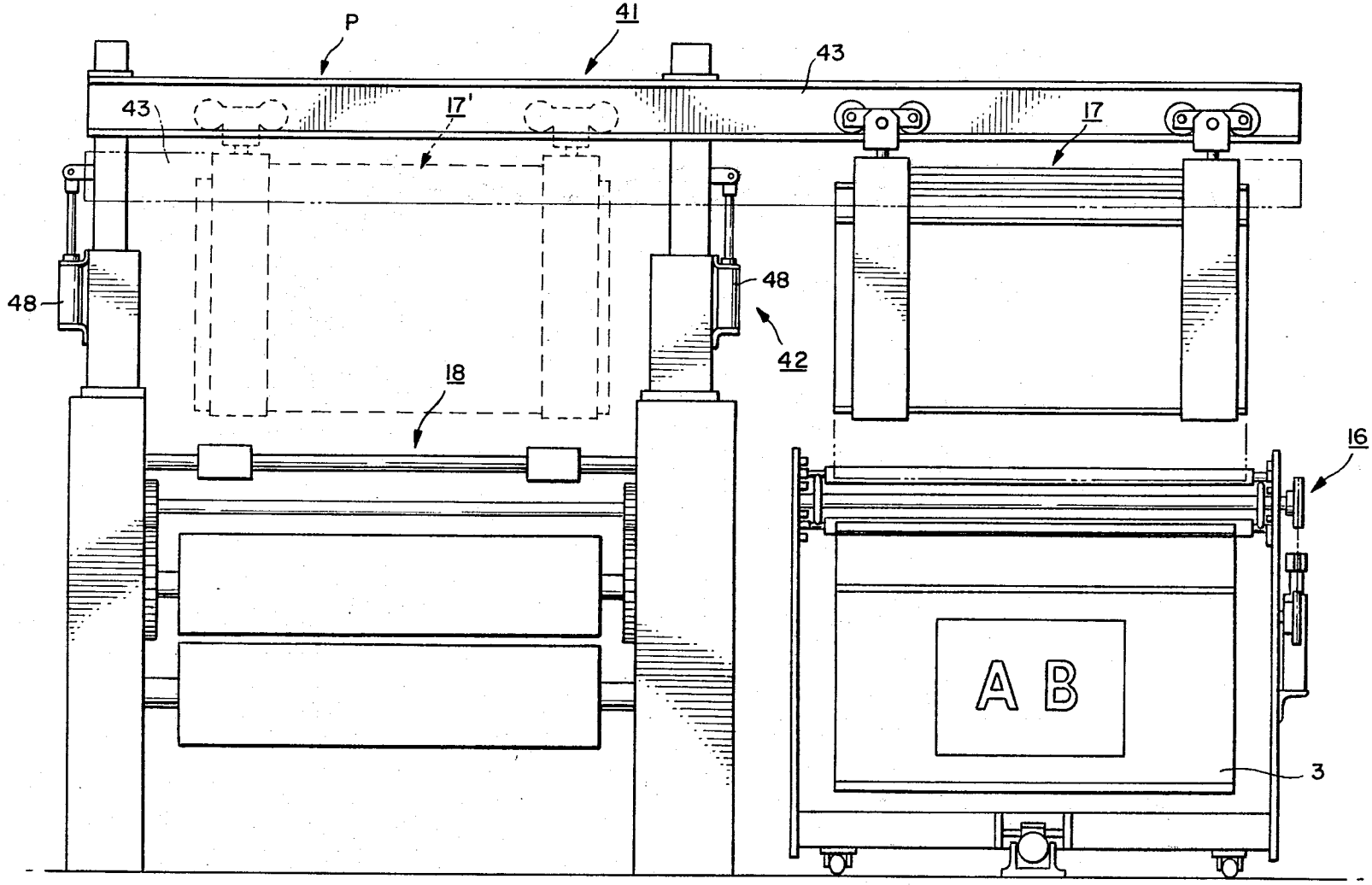
Figure 10:
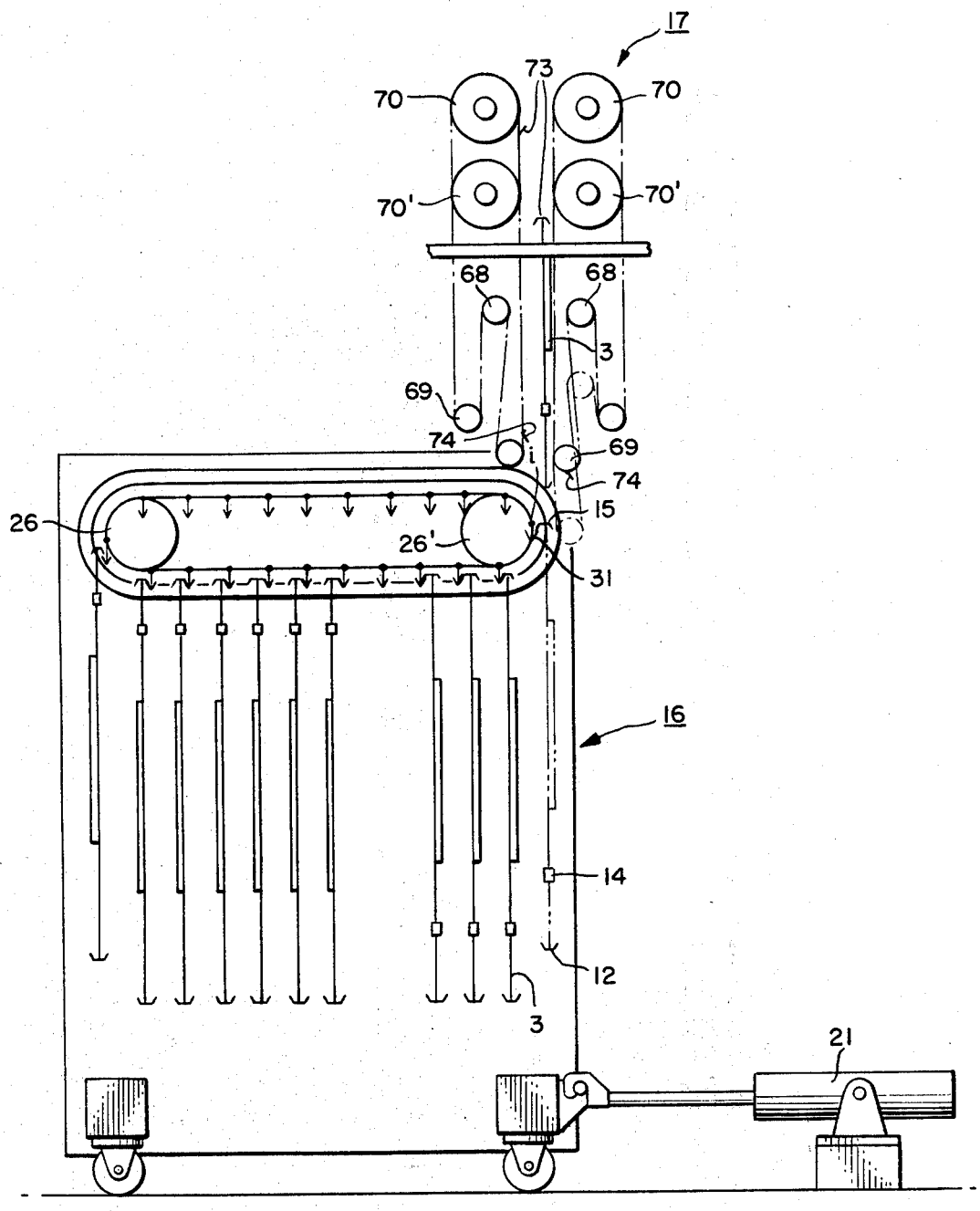
Figure 11:
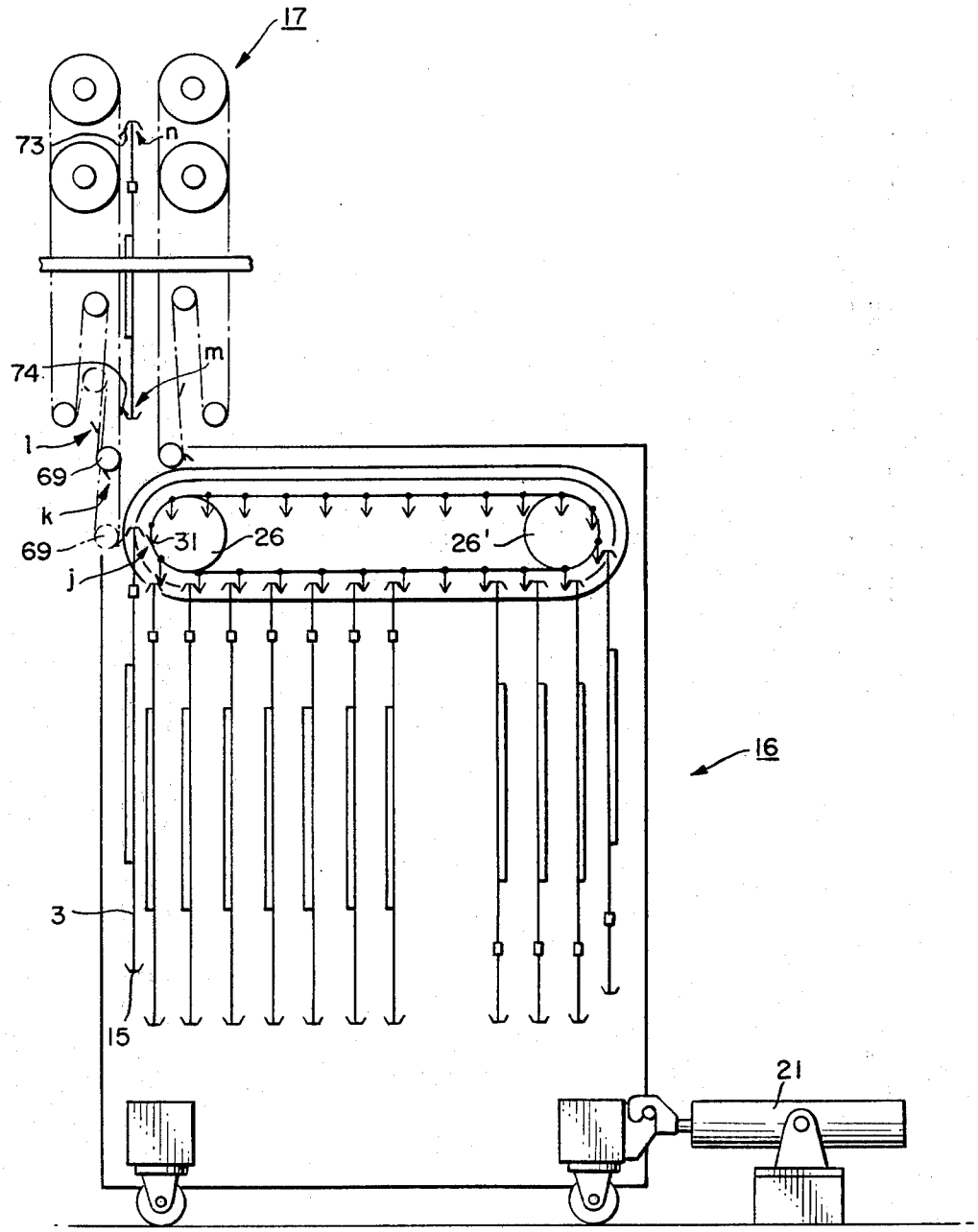
Figure 12A:
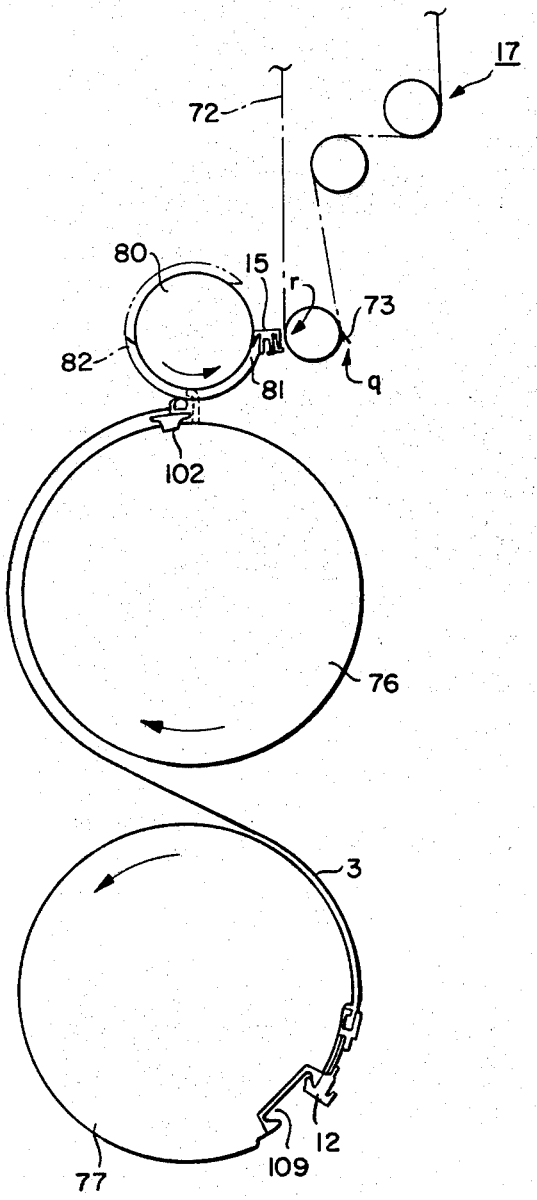
Figure 12B:
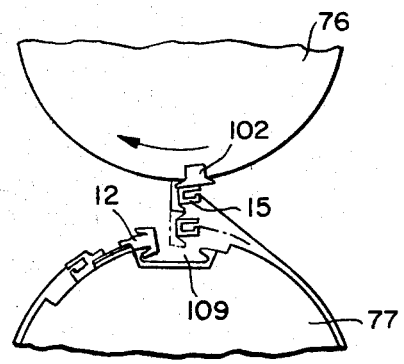
Figure 12C:
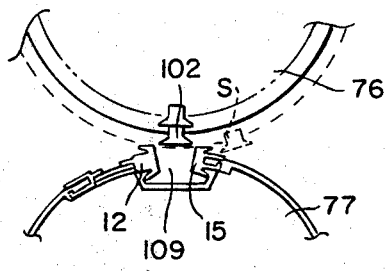
Figure 13A:
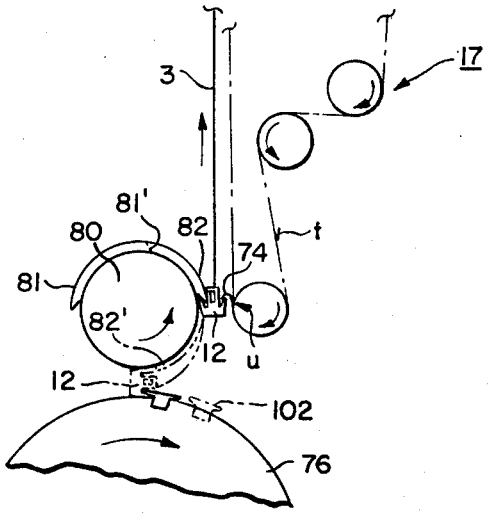
Figure 13B:
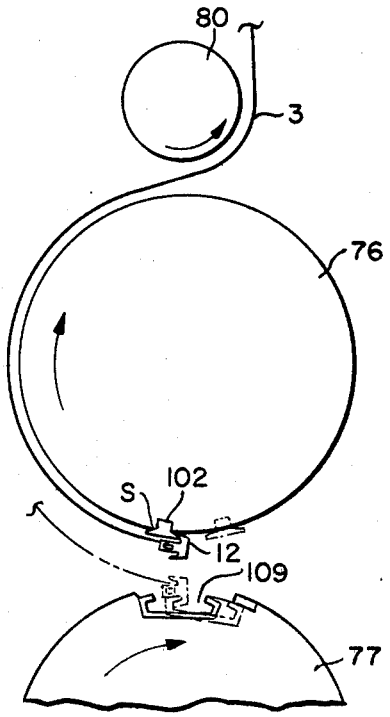
Figure 14A:
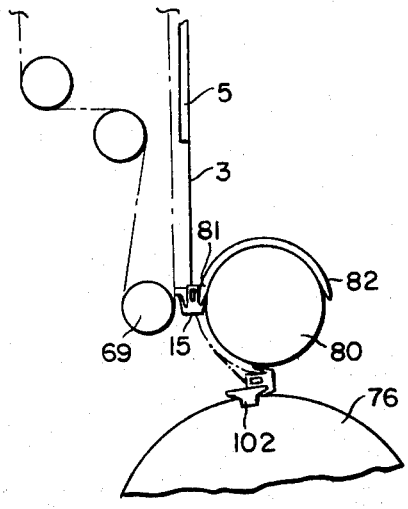
Figure 14C:
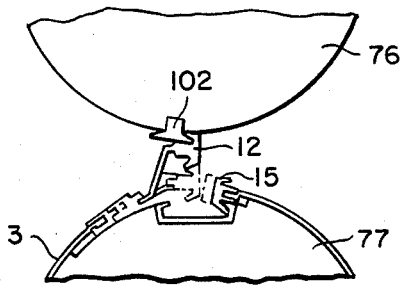
Figure 14B:
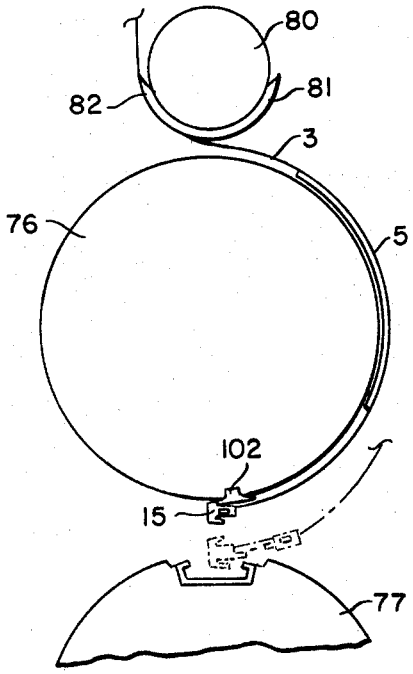
Figure 14D:
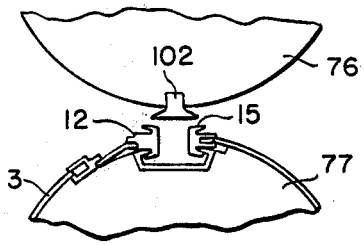

The above-mentioned and other objects, features and advantages of the present invention will become more apparent by reference to the following description of a preferred embodiment of the invention taken in conjunction with the accompanying drawings, wherein:

FIG. 1 is a side view of a printing section of upper printing type in a paper working machine in the prior art, FIG. 2 is a perspective view of a plate sheet having a front fixture strip and a rear fixture strip attached thereto, FIG. 3(*a*) and 3(*b*) are enlarged side views showing an essential part of a printing cylinder in FIG. 1, FIG. 4 is a perspective view showing a plate sheet according to one preferred embodiment of the present invention, FIG. 5(*a*) is a perspective view showing a preset apparatus according to one preferred embodiment of the present invention, FIG. 5(*b*) is a cross-section view taken along line A—A in FIG. 5(*a*), FIG. 6 is a cross-section front view of a plate conveyor apparatus according to one preferred embodiment of the present invention, in which the plate carrier on the left hand is shown in cross-section taken along line B—B in FIG. 7, while the plate carrier on the right hand is shown as viewed in the direction of arrow C in FIG. 7, FIG. 7 is a side view of the plate conveyor apparatus in FIG. 6, FIG. 8(*a*) is a cross-section front view of a plate exchange apparatus according to one preferred embodiment of the present invention, FIG. 8(*b*) is a cross-section view taken along line D—D in FIG. 8(*a*), FIG. 9 is a front view of an automatic printing plate exchange system according to one preferred embodiment of the present invention, which comprises a plate exchange apparatus, a plate conveyor apparatus and a preset apparatus, FIGS. 10 and 11 are side views showing the same preset apparatus in different operating states, respectively, and FIGS. 12(*a*), 12(*b*), and 12(*c*), FIGS. 13(*a*) and 13(*b*), and FIGS. 14(*a*), 14(*b*), 14(*c*) and 14(*d*), respectively, are schematic side views showing the states of a printing cylinder and a receiving cylinder engaged with each other in successive steps of three different phases of operation.

Now the present invention will be described in greater detail in connection to its preferred embodiment illustrated in the accompanying drawings. FIG. 4 is a perspective view showing the state of a plate sheet (3) in the prior art having special fixture jigs attached thereto for the purpose of automatically mounting and dismounting a printing plate onto and from a printing cylinder in an automatic printing plate exchange system according to one preferred embodiment of the present invention. FIG. 5 shows a preset apparatus (16) for preliminarily accommodating plate sheets (3) in a correct order according to the scheduled sequence of use on that day. FIG. 6 shows a plate conveyor apparatus (41) for conveying plate sheets (3) successively from the preset apparatus (16) to a plate exchange apparatus (18). It is to be noted that in FIG. 6 the left hand plate carrier (17) is shown in cross-section taken along line B—B in FIG. 7.

FIG. 7 is a side view of the plate conveyor apparatus (41), FIG. 8(*a*) is a cross-section front view of the plate exchange apparatus (18), and FIG. 8(*b*) is a cross-section view taken along line D—D in FIG. 8(*a*). FIG. 9 is a front view of an automatic printing plate exchange system comprising the plate exchange apparatus (18), the plate conveyor apparatus (41) and the preset apparatus (16). FIG. 10 is a schematic side view showing the state where a plate sheet (3) is being sent from the plate carrier (17) to the preset apparatus, and FIG. 11 is a schematic side view showing the state where a plate sheet (3) is being sent from the preset apparatus (16) to the plate carrier (17).

The illustrated system according to one preferred embodiment of the present invention is composed of the plate sheet (3) having special jigs, the plate preset apparatus (16), the plate carrier (17) and the plate exchange apparatus (18) as shown in FIG. 9. At first, as shown in FIG. 4, a fixture jig (14) to be fittingly engaged with a front fixture strip (6) of a plate sheet (3) in the prior art, is connected to a rubber belt (13), and the other end of the rubber belt (13) is connected to another fixture jig (12) having an anchor-shaped protrusion. In addition, a rear fixture strip (7) of the plate sheet (3) is fittingly engaged with a fixture jig (15) having an anchor-shaped protrusion similar to the above-described fixture jig (12).

The preset apparatus is made to be movable by mounting casters at four corners of its bottom surface as shown in FIG. 5. In addition, at the center of the side surface of its lower horizontal frame is mounted a U-shaped handle (20), and a hook (22) mounted at a front end of a piston rod of a cylinder (21) is detachably coupled to a horizontal member (20') of the U-shaped handle (20). The cylinder (21) pivotably supported by a support member (24).

At the upper portion of the preset apparatus (16) are rotatably supported shafts (25) and (25'), and on these shafts are mounted sprockets (26) and (26'), respectively. As shown in FIG. 5(*b*), a one-way clutch (27) is mounted on the shaft (25'), and a sprocket (36) is fixedly secured to the side surface of the one-way clutch (27). The sprocket (26) mounted on the rotary shaft (25) is coupled to the sprocket (26') via a chain (29).

At one end of a special attachment (30) provided on the chain (29) is rotatably mounted a V-shaped beam (31) for suspending the plate sheet (3), and a cam follower (32) is mounted at the other end thereof. The cam follower (32) is interposed between rails (33) and (33') provided in parallel to each other on the inside surface of a side frame (110) of the preset apparatus (16). In addition, another sprocket is rotatably provided on the same side frame (110) at a position right under the shaft (25'), and this sprocket (34) is coupled to the above-described sprocket (36) via a chain (35).

Reference numeral (38) designates a cylinder provided on the side frame (110), and a rod end of this cylinder (38) is coupled to the chain (35) at a point a in FIG. 5 so that the sprocket (36) can be rotated by actuating the cylinder (38). The bottom end of the cylinder (38) is fixed to the side frame (110) via a support member (40). As a result, in response to one stroke of reciprocating motion of the cylinder (38), the sprocket (26') is rotated in one direction by a predetermined angle via the one-way clutch (27).

As shown in FIG. 6, the plate conveyor apparatus (41) consists of a track elevator (42) and a plate conveying carrier (17). Reference numeral (43) designates a track, which is suspended from one ends of inverse L-shaped beams (44) and (44'). Vertical portions (44'') of the inverse L-shaped beams (44) and (44') are slidably fitted in support beams (45) provided on the top surface of a frame (79) of the printing section (2). A piston rod (47) of a cylinder (48) is coupled to a pin (46) provided on the side surface of the inverse L-shaped beam (44), and the cylinder (48) is fixedly secured to the side surface of the support beam (45). Furthermore, racks (49) fixedly secured to other side surfaces of the support beams (45) mesh with pinions (51) and (51') provided at the opposite ends of a shaft (50) which is pivotably supported between the inverse L-shaped beams (44) and (44').

With reference to FIG. 7, wheels (53) rotatably mounted to a U-shaped frame (52) make contact with inside surfaces of flange portions of the track (43) having an I-shaped cross-section so that the carrier (17) can travel along the track (43). On the bottom surface of the flange portions of the track (43) is fixedly secured a rack (54), and a pinion (55) is disposed at a position adapted to mesh with the rack (54). A motor (56) coupled to the pinion (55) is fixedly secured to a bottom plate (57) of the U-shaped frame (52).

In addition, as shown in FIG. 6, at the center of the bottom surface of the U-shaped frame (52) is provided a fulcrum (58), and a frame (59) is rotatably mounted at the fulcrum (58). In the upper portion of the frame (59) are rotatably supported rotary drive shafts (61) and (61') as penetrating through a support base (60), one ends of these rotary drive shafts (61) and (61') are connected to drive motors (62) and (62'), respectively, and the other ends are connected via universal joints (63) and (63') to rotary drive shafts (64) and (64') of the adjacent carrier (17').

On the bottom surface of the support base (60) are fixedly secured cylinders (65), support beams (67) are mounted at the bottom end of the piston rods (66) of the cylinders (65), and in two slots of each support beam (67) are rotatably mounted sprockets (68) and (69), respectively. On the above-described rotary drive shafts (61) and (61') are mounted sprockets (70) and (71), respectively, and further, as shown in FIG. 7, in the lower position of the frame (59) are also rotatably mounted sprockets (71). These sprockets (68), (69), (70), (70') and (71) are coupled through chains (72) and (72'), respectively.

As shown on the right side plate carrier (17') in FIG. 6, an upper claw (73) is mounted on the chains (72), a lower claw (74) is mounted on the chains (72'), and these claws (73) and (74) has a configuration adapted to engage with the anchor-shaped protrusions (12') and (15'), respectively, of the fixture jigs (12) and (15) of the plate sheet (3). It is to be noted that the plate carrier (17) on the left hand in FIG. 6 is shown in cross-section taken along line B—B in FIG. 7, and the piston rod (66) of the cylinder (65) is shown in a retracted state. Whereas, the plate carrier (17') on the right hand in FIG. 6 is shown as viewed in the direction of arrow C in FIG. 7.

As shown in FIG. 8, the plate exchange apparatus (18) is constructed of a feed-in cam device (75), a receiving roll (76), a printing cylinder (77) and a driving device (78) for the respective devices. On a frame (79) of a printing section (2) is rotatably mounted a cam shaft (80) and on this shaft are mounted a plurality of claws (83) each consisting of a rear edge claw (81) and a front edge claw (82). At one end of the cam shaft (80) is provided a gear (84), and a gear (85) meshed with the gear (84) is coupled via a coupling member (86) to a motor (87). The motor (87) is fixed on the frame (79) by the intermediary of a support base (88). In addition, at the other end of the cam shaft (80) is mounted a pulse generator (89) for detecting an angular position of the cam shaft (80).

The receiving roll (76) is supported between the frames (79) in parallel to the cam shaft (80), and its axial end portions (76') are rotatably supported by eccentric bearings (90), which are in turn rotatably mounted to the frames (79). Furthermore, the eccentric bearings (90) are engraved into sector gears (91), and the sector gears (91) are meshed with pinions (93) provided on the opposite end portions of a pinion shaft (92) which is pivotably mounted in parallel to the receiving roll (76).

One axial end of the pinion shaft (92) is coupled via a coupling member (94) to a motor (95). At the other end of the motor (95) is mounted a pulse generator (96) for detecting an angular position of the pinion shaft (92). The gap space between the receiving roll (76) and the printing cylinder (77) can be adjusted by the rotation of the motor (95). At one axial end of the receiving roll (76) is mounted a gear (97), and another gear (98) meshed with the gear (97) is coupled via a clutch (99) to a motor (100). This motor (100) is fixed to the frame (79) via the support base (88). In addition, at the other axial end of the receiving roll (76) is mounted a pulse generator (101) for detecting an angular position of the receiving roll (76).

The outer circumferential length of the receiving roll (76) is equal to the total length of the plate sheet (3) and the associated fixture jigs (12), (13), (14) and (15), and the receiving roll (76) would rotate one revolution for one revolution of rotation of the printing cylinder (77). On the outer circumference of the receiving roll (76) is fixedly secured a claw belt (102) having an anchor-shaped cross-section, and this anchor-shape is such configuration that can be engaged with the fixture jigs (12) and (15) of the plate sheet (3).

The printing cylinder (77) is pivotably mounted in parallel to the receiving roll (76) and rotatably supported by the frames (79). The axial end portion of the printing cylinder (77) rotatably supports a gear (102') and a rotor section (103') of a clutch (103). The rotor section (103') is connected to the gear (102') and an armature section (103'') of the clutch (103) is fixedly engaged with the axial end portion of the printing cylinder (77). Accordingly, engagement and disengagement of a drive force transmission system from the printing cylinder (77) to the receiving roll shaft (76) are possible. In addition, at the other axial end portion of the printing cylinder (77) is mounted a pulse generator (104) for detecting an angular position of the printing cylinder.

A gear (105) meshing with the above-described gear (105) is rotatably mounted on the frame (79), and is also connected to a motor (107) via a clutch (106). The motor (107) is fixed to the frame (79) by the intermediary of a support member (108). On the other hand, on the outer circumferential surface of the printing roll (77) is provided a slot having a cross-section shape that can be engaged with the protrusions (12'') and (15'') of the plate fixture jigs (12) and (15).

Now, operations of the above-described automatic printing plate exchange system will be described. At first, description will be made on a recovering operation of a plate sheet (3) from the plate carrier (17) to the preset apparatus (16). As shown in FIG. 9, when the plate carrier (17) stops at a predetermined position on the track (43) right above the preset apparatus (16), the cylinders (48) are actuated, and so the track (43) is lowered to the position shown by double-dot chain lines in FIG. 9.

The V-shaped beam (31) is standing by at the position marked (i) in FIG. 10, and when the drive motors (62) and (62') in the plate carrier (17) begin to rotate simultaneously, the upper claw (73) and the lower claw (74) holding the plate sheet (3) are both lowered, and the plate sheet (3) is also lowered. When the low claw (74) passes by the left side of the sprocket (69), the low claw (74) is disengaged from the plate fixture jig (12) and continues to move in itself, and at the time point when it passes along the sprocket (69) in the rightward direction, it stops there in a standby state.

When the above-mentioned fixture jig (12) passes by the right side of the V-shaped beam standing by at the above-mentioned position (i) in FIG. 10, the air cylinder (65) is actuated and hence the sprocket (69) is lowered. As a result, a guide surface for facilitating engagement between the rear plate fixture jig (15) and the V-shaped beam (31) can be formed. The position of the sprocket

(69) at that moment is shown by double-dot chain lines in FIG. 10.

When the V-shaped beam (31) has passed by the right side of the V-shaped beam (31), the plate sheet (3) is engaged with the V-shaped beam (31) to be held thereby, the upper claw (73) continues to move in itself and when it has reached the right side of the sprocket (69), the motor (62) stops and hence the upper claw (73) stops movement. The position of the plate sheet (3) at that moment is shown by double-dot chain lines in FIG. 10. Thereafter, the air cylinder (65) is again actuated, hence the sprockets (68) and (69) would restore from the position shown by double-dot chain lines to the position shown by solid lines, and thereby recovery of the plate sheet (3) into the preset apparatus (16) has been completed.

Now, description will be made on the operation for loading the plate sheet (3) from the preset apparatus (16) into the plate carrier (17). The preset apparatus (16) placed at the position shown in FIG. 10 is moved to the position shown in FIG. 11 by the retracting operation of the cylinder (21), and at the same time, the V-shaped beams (31) having the plate sheet (3) suspended therefrom is moved up to the position marked (j) in FIG. 11 by reciprocating movement of the cylinder (38), and is held at that position.

Then, the drive motors (62) and (62') for the upper claw (73) and the lower claw (74), respectively, of the plate carrier (17) which have been standing by at the upper positions, are simultaneously actuated, hence the upper claw (73) and the lower claw (74) would be lowered, and when they have reached the positions (k) and (l) shown by solid lines in FIG. 11, they are stopped and held at those positions. Subsequently, the air cylinder (65) is actuated, and so, the sprocket (69) is moved from the position shown by solid lines in FIG. 11 to the position shown by double-dot chain lines.

Next, owing to the fact that the drive motors (62) and (62') for the upper claw (73) and the lower claw (74), respectively, are actuated again, the upper claw (73) and the lower claw (74) are moved, and when the upper claw (73) has passed by the left side of the sprocket (26), the upper claw (73) engages with the plate fixture jig (12), hence the plate sheet (3) begins to rise at the same speed as the upper claw (73). When the rising lower claw (74) has reached the position marked (m) in FIG. 11, only the lower claw (74) is stopped and held at that position.

As the upper claw (73) and the plate sheet (3) continues to rise jointly, when the upper claw (73) has reached a position a few centimeters before the point marked (n) in FIG. 11, the rear plate fixture jig (15) would engage with the lower claw (74) held at the position (m), and as the upper claw (73) rises further, the rubber belt (17) provided above the plate sheet (3) is stretched, hence a tension is applied uniformly to the plate sheet (3). When such a state has been established, the upper claw (73) reaches the position (n) in FIG. 11, and then it is stopped and held there.

Accordingly, owing to the application of the tension to the plate sheet (3), the plate sheet (3) is prevented from being displaced when the plate carrier (17) moves from the preset apparatus (16) to the plate exchange apparatus (18). Then, the air cylinder (65) is again actuated, so that the sprocket (69) moves from the position shown by double-dot chain lines in FIG. 11 to the position shown by solid lines. Through the aforementioned steps of operation, the loading of the plate sheet (3) from the preset apparatus (16) into the plate carrier (17) has been completed.

Now, description will be made on the operation for conveying the plate sheet (3) by means of the plate carrier (17) from the preset apparatus (16) to the printing section (2). When the cylinders (48) are actuated, the track (43) located at the position shown by double-dot chain lines in FIG. 9 rises up to the position shown by solid lines in FIG. 9. Subsequently, the drive motor (56) provided on the plate carrier (17') is actuated, hence the plate carrier (17) moves along the track (43) from the right to the left, and when it has reached a predetermined position (p) above the printing section (2), automatically it stops. That position is shown by dash lines in FIG. 9.

Next, description will be made on the operation for recovering a used plate sheet (3) from the plate exchange apparatus to the plate carrier (17). As shown in FIG. 7, in response to actuation of the air cylinders (65), the sprockets (69) are lowered, and after they have moved up to the positions shown in FIG. 7, they would stop. At those positions, the center axis of the cam shaft (80) and the center axes of the sprockets (69) align on the same horizontal plane.

Subsequently, the receiving roll (76) and the printing cylinder (77) are simultaneously rotated by the motor (100) until they reach the angular positions shown in FIG. 12(*c*). At this moment, the clutch (103) is connected to the gear (102'), the clutch (106) is opened, and the clutch (99) is kept in a connected state.

Next, the receiving roll (76) is raised from the position shown by solid lines to the position shown by double-dot chain lines in FIG. 12(*c*) by actuating the motor (95) to rotate the eccentric gear (90) via the pinion (93). In addition, after only the receiving roll (76) has been rotated in the anti-clockwise direction as viewed in FIG. 12 by actuating the motor (100), the receiving roll (76) is lowered through an operation in the opposite direction to that when the remaining roll (76) was raised. At this moment, the clutch (103) and the clutch (106) are both in an opened state, while the clutch (99) is held connected. The position of the receiving roll (76) at this time is shown by dash lines in FIG. 12(*c*).

Then, under the above-mentioned states of the respective clutches, the motor (100) is actuated to rotate only the receiving roll (76) in the clockwise direction as viewed in FIG. 12 until the receiving roll (76) reaches the position shown by double-dot chain lines in FIG. 12(*b*). Furthermore, when the receiving roll (76) has been raised by actuating the motor (95), the receiving roll takes the state shown by solid lines in FIG. 12(*b*), and so, the rear plate fixture jig (15) can be completely disengaged from the protrusion of the slot (109) on the printing cylinder (77).

Next, the clutch (103) is connected to the gear (102'), the clutch (106) is opened, and while the clutch (99) is kept connected, the motor (100) is again actuated to rotate the receiving roll (76) and the printing cylinder (77) simultaneously, and when the claw belt (102) has reached the position shown in FIG. 12(*a*), the motor (100) is stopped. It is to be noted that before the receiving roll (76) attains the above-mentioned state, the cam shaft (80) has been retired from the position shown by solid lines to the position shown by double-dot chain lines in FIG. 12(*a*) by actuating the motor (87).

Subsequently, the claw (81) for the rear end which has been retired to the position shown by double-dot chain lines is rotated in the clockwise direction as viewed in FIG. 12 at a circumferential speed equal to the outer circumferential speed of the receiving roll (76) by actuating the motor (87). Then, at the moment when the rear plate fixture jig (15) has engaged with the claw (81) for the rear end, the receiving roll (76) and the printing cylinder (77) are started to rotate in the direction of arrows in FIG. 12(*a*) by actuating the motor (100). Since this moment, the engagement between the claw belt (102) of the receiving roll (76) and the rear fixture jig (15) has been cleared, and the rear fixture jig (15) would move along the circumference of the cam shaft (80). Under the aforementioned condition, the cam shaft (80), the receiving roll (76) and the printing cylinder (77) would continue to rotate, and when the rear fixture jig (15) has reached the position shown by solid lines in FIG. 12(*a*), the above-mentioned respective shafts or rolls (80), (76) and (77) would stop at the same time.

Subsequently, the upper claw (73) which has been placed at the position (q) in FIG. 12(*a*), is rotated in the clockwise direction as viewed in FIG. 12 at the same circumferential speed as that of the outer circumferential surface of the receiving roll (76) by actuating the motor (87), and at the moment when the upper claw (73) has engaged with the above-described rear fixture jig (15) at the position (r), the receiving roll (76) and the printing cylinder (77) which have been held stopped by that moment, are started to rotate at the same circumferential speed, hence the rear fixture jig (15) is disengaged from the claw (81) for the rear end on the cam shaft (80), and it begins to rise along the chain (72) of the carrier (17').

On the other hand, the claw (81) for the rear end which has been disengaged from the rear fixture jig (15) is standing by at the positions (81')–(82') shown by double-dot chain lines in FIG. 13(*a*) after it has been rotated in the anti-clockwise direction as viewed in FIG. 13 by actuating the motor (87), in preparation for next engagement with the front fixture jig (12). Likewise, the claw belt (102) of the receiving roll (76) which has been disengaged from the rear fixture jig (15), rotates in synchronism with the movement of the printing cylinder (77) which is rotating as engaged with the front fixture jig (12) of the plate sheet (3), and at the time point when the claw belt (102) has reached the position (S) in FIG. 13(*b*), the motors (87) and (100) are stopped, and hence, movement of the claw belt (102) is also stopped.

Next, after the clutch (103) which has been connected so far, has been opened to release the connection to the printing cylinder (77), only the receiving roll (76) is rotated in the clockwise direction as viewed in FIG. 13 by actuating the motor (100), and it is stopped at the position shown by solid lines in FIG. 13(*b*). Furthermore, in response to actuation of the motor (95), the receiving roll (76) is lowered, and it stands by at the position where it can be engaged with the front fixture jig (12).

Then, by actuating the motor (107) while connecting the clutches (103) and (106) and opening the clutch (99), only the printing cylinder (77) is rotated in the anti-clockwise direction as viewed in FIG. 13, hence the engagement between the front fixture jig (12) and the protrusion of the slot (109) on the printing cylinder (77) is released, and the front fixture jig (12) becomes to be engaged with the claw belt (102). The rotation of the printing cylinder (77) is stopped when the slot (109) has come to the position shown by solid lines from the position shown by double-dot chain lines in FIG. 13(*b*). Subsequently, by actuating the motor (95) again, the receiving roll (76) is raised and the engagement is completely cleared. This state is shown in FIG. 13(*b*).

Subsequently, when the motors (100) and (62) are actuated while releasing the clutches (106) and (103) and connecting the clutch (99), the rear fixture jig (15) of the plate sheet (3) rises again along the chain (72), and when the front fixture jig (12) has reached the position shown by double-dot chain lines in FIG. 13(*a*), the cam shaft (80) is rotated in the anti-clockwise direction as viewed in FIG. 13 by actuating the motor (87) again, as a result the front fixture jig (12) is disengaged from the claw belt (102) and is engaged with the claw (82) for the front end on the cam shaft (80), so that the front fixture jig (12) is moved along the circumference of the cam shaft (80).

On the other hand, the claw belt (102) which was disengaged from the front fixture jig (12) is stopped when it has reached the position shown by double-dot chain lines in FIG. 13(*a*). During the period when the front fixture jig (12) is moving along the circumference of the cam shaft (80), the rear claw (74) is rotated in the clockwise direction as viewed in FIG. 13 from the position marked (t) to the position marked (u) in FIG. 13(*a*) by actuating the motor (62'), and after it has stopped there it stands by.

Next, when the front fixture jig (12) has reached the position shown by solid lines in FIG. 13(*a*), the rear claw (74) begins to rise by actuating the motor (62') again, as a result the engagement between the front fixture jig (12) and the front end claw (82) is released, and the front fixture jig (12) rises jointly with the rear claw (74) as engaged therewith. On the other hand, the claw (82) for the front end which has disengaged from the front fixture jig (12), continues to rotate by 180° in the anti-clockwise direction as viewed in FIG. 13, and thereafter stops to stand by for the next mounting operation of the plate sheet (3). In addition, both the upper claw (73) and the lower claw (74) which are rising jointly with the plate sheet (3), would stop at the time point when the upper claw (73) has reached its upper limit, and then the recovery of the used plate sheet (3) has been completed.

Explaining now the operation for mounting the plate sheet (3), this operation is entirely the opposite operation to the above-described operation for recovering the plate sheet (3), and therefore, detailed description thereof will be omitted here. It is to be noted that the illustration of the successive steps in the mounting operation is given in FIGS. 14(*a*), 14(*b*), 14(*c*) and 14(*d*). The successive steps are carried out in the sequence of FIG. 14(*a*), FIG. 14(*b*), FIG. 14(*c*) and FIG. 14(*d*), and the mounting of the plate sheet (3) has been completed at the step shown in FIG. 14(*d*).

Since the automatic printing plate exchange system according to the present invention is constructed as described above, as compared to the manual operation system in the prior art it becomes unnecessary to open the frames of the printing section and the paper feed section for the purpose of reversing a working space each time the printing plate is to be exchanged. In addition, the plate sheets can be preset outside of the printing machine, and moreover, if the printing machine is coupled to a plate storage instead of the preset apparatus and the works of exchanging the plates, storing them in the plate storage, etc. are controlled by a microcomputer, then it is possible to expand the printing machine into one printing system. Furthermore, owing to the fact that automatic mounting/dismounting of a plate sheet onto and from a printing system can be achieved, the time required for setup is greatly shortened and hence a productivity is enhanced. Also, if expansion of the printing machine into one system is realized, then it is possible to save labor, and due to the fact that opening and closing of the frames have become unnecessary, a safety of the system can be greatly improved.

Since many changes could be made in the above construction and many apparently widely different embodiments of this invention could be made without departing from the scope thereof, it is intended that all matter contained in the above description or shown in the accompanying drawings shall be interpreted as illustrative and not as a limitation to the scope of the invention.

What is claimed is:

1. An automatic printing plate exchange system comprising plate holding means adapted to be mounted to a printing plate while presenting a resilient effect as a whole and having anchor-shaped engaging sections along its front and rear edges, send-out means for sequentially sending out plates, which have been preliminarily arranged in a predetermined order, up to predetermined position, conveyor means for receiving the plate sent out from said send-out means by engaging with the anchor-shaped engaging section of said plate holding means and conveying the plate up to a predetermined position above a printing section, a printing cylinder on which said plate can be mounted, and delivery means for receiving the plate from the conveyor means by engaging with the anchor-shaped engaging section and delivering the plate to said printing cylinder.

* * * * *